US012245668B1

(12) United States Patent
Slayton

(10) Patent No.: US 12,245,668 B1
(45) Date of Patent: Mar. 11, 2025

(54) REUSABLE ADHESIVE WEARABLE APPARATUS

(71) Applicant: EJSlay LLC, Atlanta, GA (US)

(72) Inventor: Emily Sanders Slayton, Marietta, GA (US)

(73) Assignee: EJSlay LLC, Atlanta, GA (US)

( * ) Notice: Subject to any disclaimer, the term of this patent is extended or adjusted under 35 U.S.C. 154(b) by 0 days.

(21) Appl. No.: 18/813,408

(22) Filed: Aug. 23, 2024

(51) Int. Cl.
*A44C 5/00* (2006.01)

(52) U.S. Cl.
CPC ..... *A44C 5/0007* (2013.01)

(58) Field of Classification Search
CPC ..... A44C 15/003; A44C 5/0084; A44C 5/12; A44C 9/0076; A45F 2005/008; Y10T 24/1368; A47L 25/005
See application file for complete search history.

(56) References Cited

U.S. PATENT DOCUMENTS 327,759 A * 10/1885 Boyle ..... A45F 5/00 24/3.2
2,724,847 A * 11/1955 Krasno ..... A47L 25/005 15/104.94
5,215,236 A 6/1993 Waddell
6,701,531 B1 3/2004 Hayden
8,091,383 B1 * 1/2012 Zahiri ..... A44C 15/009 63/15
11,864,647 B1 1/2024 Molenda-Schroth
2008/0245831 A1 * 10/2008 Simon ..... A45F 5/00 224/267
2011/0245870 A1 * 10/2011 McKinney ..... A61J 17/02 606/235
2018/0168371 A1 6/2018 Francoeur
2018/0368538 A1 12/2018 Vanderbilt Kay
2020/0168024 A1 5/2020 Murphy
2022/0232932 A1 * 7/2022 Johnston ..... A44C 5/12

* cited by examiner

*Primary Examiner* — Jack W Lavinder
(74) *Attorney, Agent, or Firm* — Master Key IP, LLP; Justin G. Sanders

(57) ABSTRACT

A reusable adhesive wearable apparatus is disclosed. In at least one embodiment, the apparatus provides a cuff portion removably engageable with a target site, and an at least one stack of adhesive strips engaged with an outer surface of the cuff portion. Each of the at least one stack of adhesive strips provides a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object. During use of the apparatus, the uppermost adhesive strip in the at least one stack may be selectively peeled away from said stack as desired, thereby exposing the adhesive surface of a next adhesive strip in said stack.

18 Claims, 4 Drawing Sheets

REUSABLE ADHESIVE WEARABLE APPARATUS

RELATED APPLICATIONS

Not applicable.

BACKGROUND

The subject of this patent application relates generally to wearables, and more particularly to a reusable adhesive wearable apparatus configured for being both re-worn and re-used.

Applicant hereby incorporates herein by reference any and all patents and published patent applications cited or referred to in this application.

By way of background, a nature bracelet traditionally entails a length of flexible tape that is wrapped around one's wrist and engaged with itself, with the adhesive surface facing outward, thereby allowing the wearer to collect objects they find during a nature walk and place them on the bracelet. Upon completion of the nature walk, the bracelet is typically torn or cut in order to disengage it from the wearer's wrist. Thus, these traditional nature bracelets are intended for one-time use, such that a new length of tape must be manually wrapped around the wearer's wrist each time they wish to have/use such a bracelet.

Accordingly, there remains a need for an adhesive wearable that is capable of being both re-worn and re-used. Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a reusable adhesive wearable apparatus. In at least one embodiment, the apparatus provides a cuff portion removably engageable with a target site, and an at least one stack of adhesive strips engaged with an outer surface of the cuff portion. Each of the at least one stack of adhesive strips provides a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object. During use of the apparatus, the uppermost adhesive strip in the at least one stack may be selectively peeled away from said stack as desired, thereby exposing the adhesive surface of a next adhesive strip in said stack Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
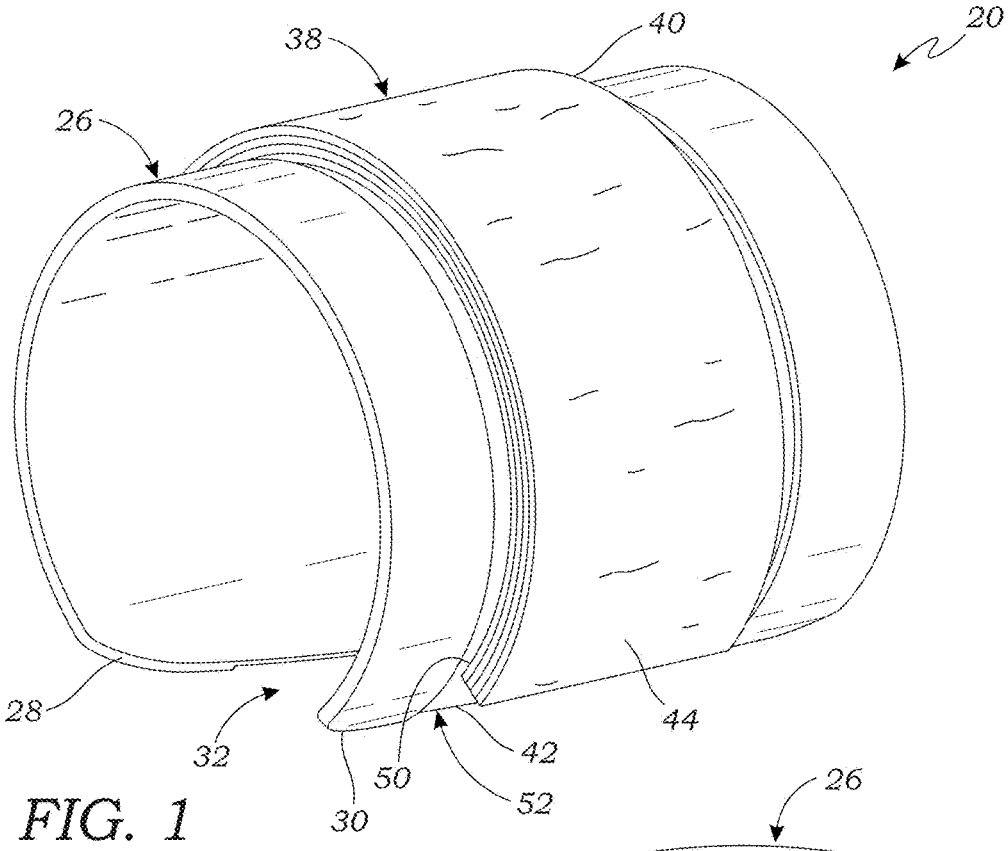
FIG. 1 is a perspective view of an exemplary a reusable adhesive wearable apparatus, in accordance with at least one embodiment.
Figure 2:
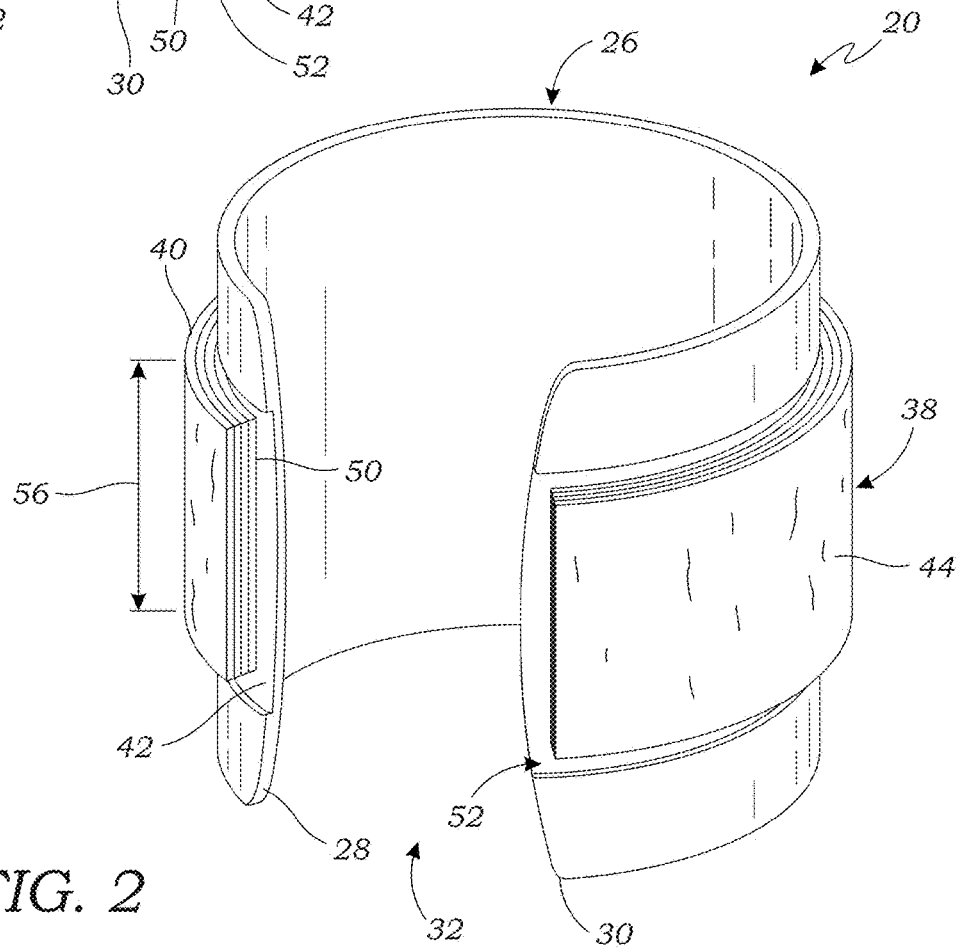
FIG. 2 is a further perspective view thereof, in accordance with at least one embodiment.

Turning now to FIGS. 1 and 2, there are shown perspective views of an exemplary embodiment of a reusable adhesive wearable apparatus 20. At the outset, it should be noted that while the apparatus 20 is shown and described primarily in the context of being configured as a bracelet positionable on a wrist of a user 24, such embodiments are merely being shown and described for illustrative purposes. In further embodiments, the apparatus 20 may be configured as any other type of wearable capable of being positionable on any other location of the user 24 (e.g., bracelet, anklet, ring, necklace, etc.), or even positionable on objects/structures other than a user 24. Thus, the apparatus 20 should not be read as being limited to only bracelet configurations. Additionally, in further embodiments, the apparatus 20 (along with each of the components described herein) may take on any other sizes, shapes, dimensions, quantities and/or configurations now known or later developed—dependent at least in part on the context in which the apparatus 20 is to be used—so long as the apparatus 20 is capable of substantially carrying out the functionality described herein.

With continued reference to FIGS. 1 and 2, in at least one embodiment, the apparatus 20 provides a cuff portion 26 configured for being removably engageable with a desired location on the user 24, object or structure (collectively referred to generally herein as a "target site" 22 for simplicity purposes). In at least one embodiment, the cuff portion 26 is constructed out of a relatively rigid material, such as plastic, metal, or wood, for example. In at least one alternate embodiment, the cuff portion 26 is constructed out of a relatively semi-rigid or resilient/flexible material, such as rubber, leather or polyvinyl chloride ("PVC"), for example. In still further embodiments, the cuff portion 26 may be constructed out of any other material or combination of materials, now known or later developed, so long as the apparatus 20 is capable of substantially carrying out the functionality described herein.

In at least one embodiment, the cuff portion 26 is sized and configured for extending around an entire circumference of the target site 22. In at least one alternate embodiment, the cuff portion 26 is sized and configured for extending around less than the entire circumference of the target site 22. In at least one embodiment, the cuff portion 26 is configured as a continuous ring-like structure (i.e., a tubular/hollow structure having virtually any shape in cross-section). In at least one alternate embodiment, as best illustrated in FIGS. 1 and 2, the cuff portion 26 is configured as a non-continuous ring-like structure having a first terminal end 28 and an opposing second terminal end 30. In such embodiments, the cuff portion 26 defines a cuff gap 32 (FIG. 2) between the first terminal end 28 and the second terminal end 30. In at least one embodiment, the cuff gap 32 is a uniformly sized space between the first terminal end 28 and the second terminal end 30. In at least one alternate embodiment, the cuff gap 32 is tapered. In further alternate embodiments, the cuff gap 32 may take on any other sizes, shapes, dimensions and/or configurations now known or later developed, so long as the apparatus 20 is capable of substantially carrying out the functionality described herein.

Figure 3:
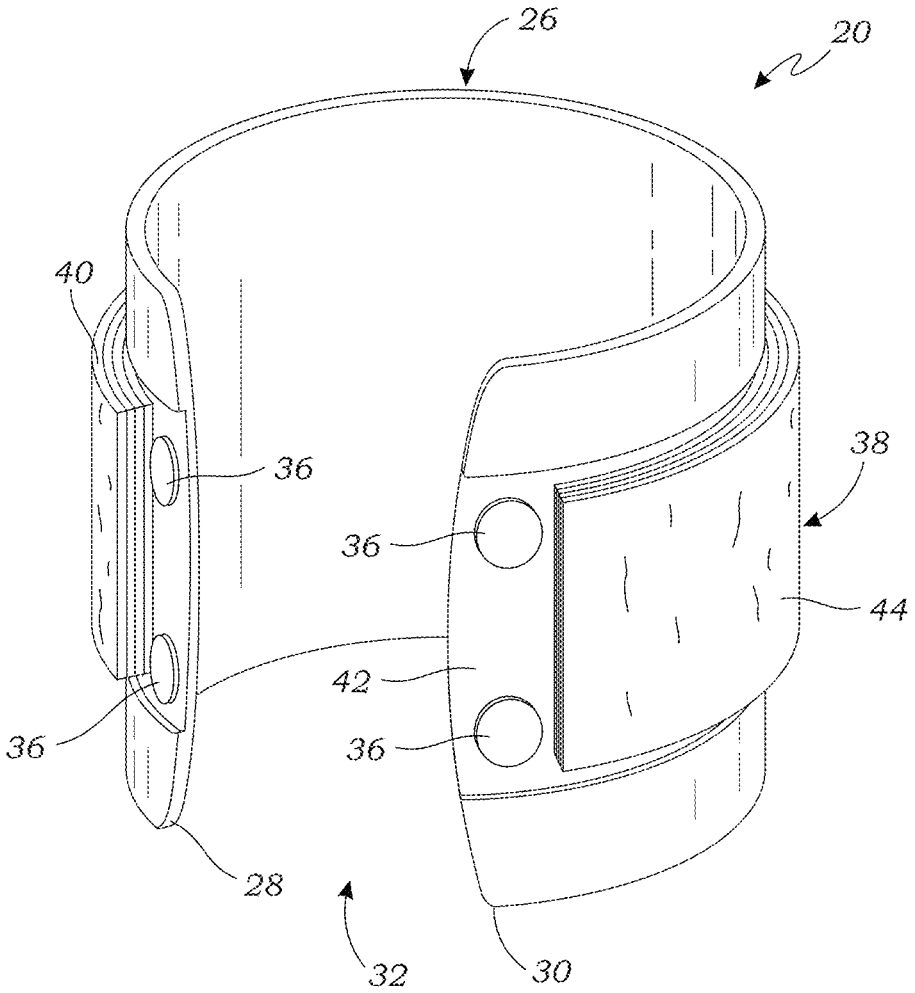
FIG. 3 is a perspective view of a further exemplary reusable adhesive wearable apparatus, in accordance with at least one embodiment.

In at least one embodiment, where the cuff portion 26 is configured as a continuous ring-like structure, the cuff portion 26 is removably engaged with the target site 22 by sliding the cuff portion 26 over and onto the target site 22. In at least one alternate embodiment, where the cuff portion 26 is configured as a non-continuous structure but is constructed out of a material that enables the cuff portion 26 to maintain a substantially ring-like, non-continuous shape (FIGS. 1 and 2), the cuff portion 26 may be removably engaged with the target site 22 by sliding the cuff portion 26 over and onto the target site 22—particularly where the cuff gap 32 has a gap width 34 that is smaller than a width of the target site 22 (so that the target site 22 is unable to slip through the cuff gap 32). In at least one such embodiment, the cuff portion 26 is capable of temporarily flexing and fitting over the target site 22. In at least one further alternate embodiment, where the cuff portion 26 is configured as a non-continuous structure, the cuff portion 26 provides an at least one cuff engagement mechanism 36 positioned and configured for creating a removable engagement between the cuff portion 26 and the target site 22. In at least one such embodiment, as best illustrated in FIG. 3, the at least one cuff engagement mechanism 36 is positioned and configured for temporarily joining the first terminal end 28 and the second terminal end 30. In at least one embodiment, the at least one cuff engagement mechanism 36 is one of hook-and-loop fasteners, buttons, snaps, magnets, buckles, etc. In further embodiments, the at least one cuff engagement mechanism 36 may be any other mechanism or structure, now known or later developed, capable of creating a removable engagement between the cuff portion 26 and the target site 22.

Figure 5:
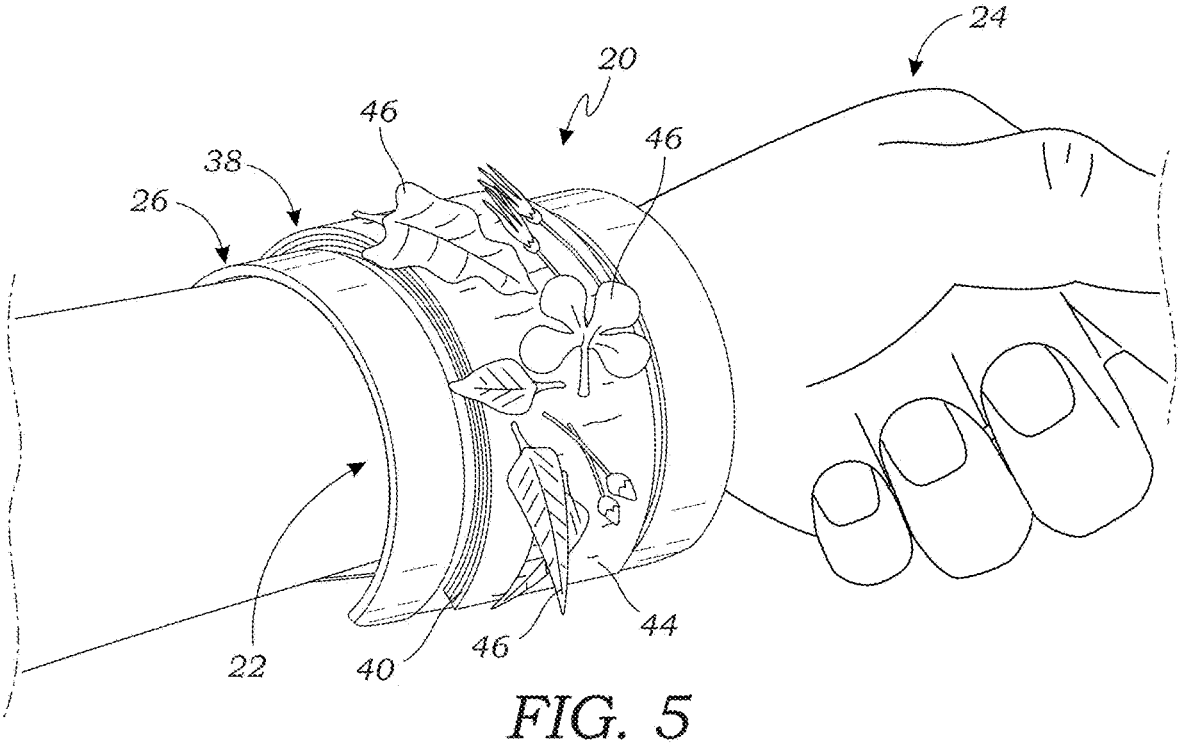
FIG. 5 is a perspective view of the apparatus positioned on a wrist of a user, in accordance with at least one embodiment.
Figure 6:
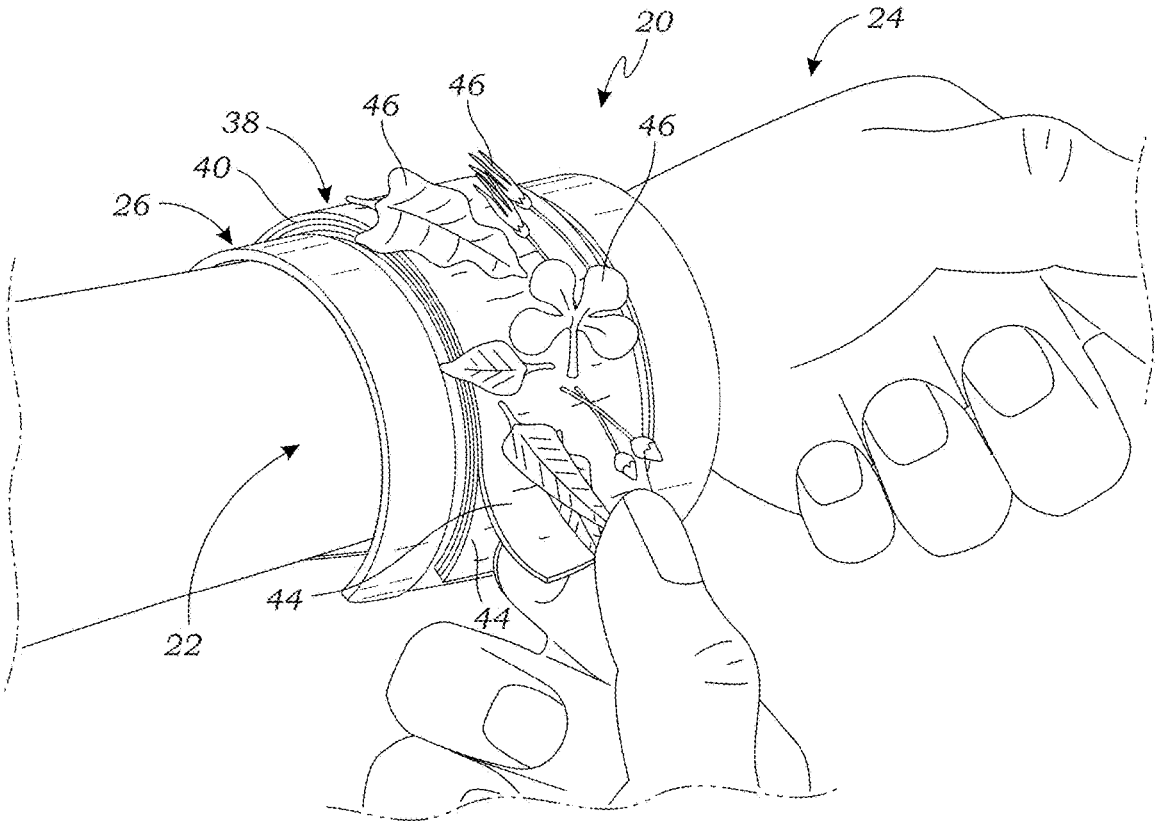
FIGS. 6 and 7 are further perspective views of the apparatus, in accordance with at least one embodiment.
Figure 7:
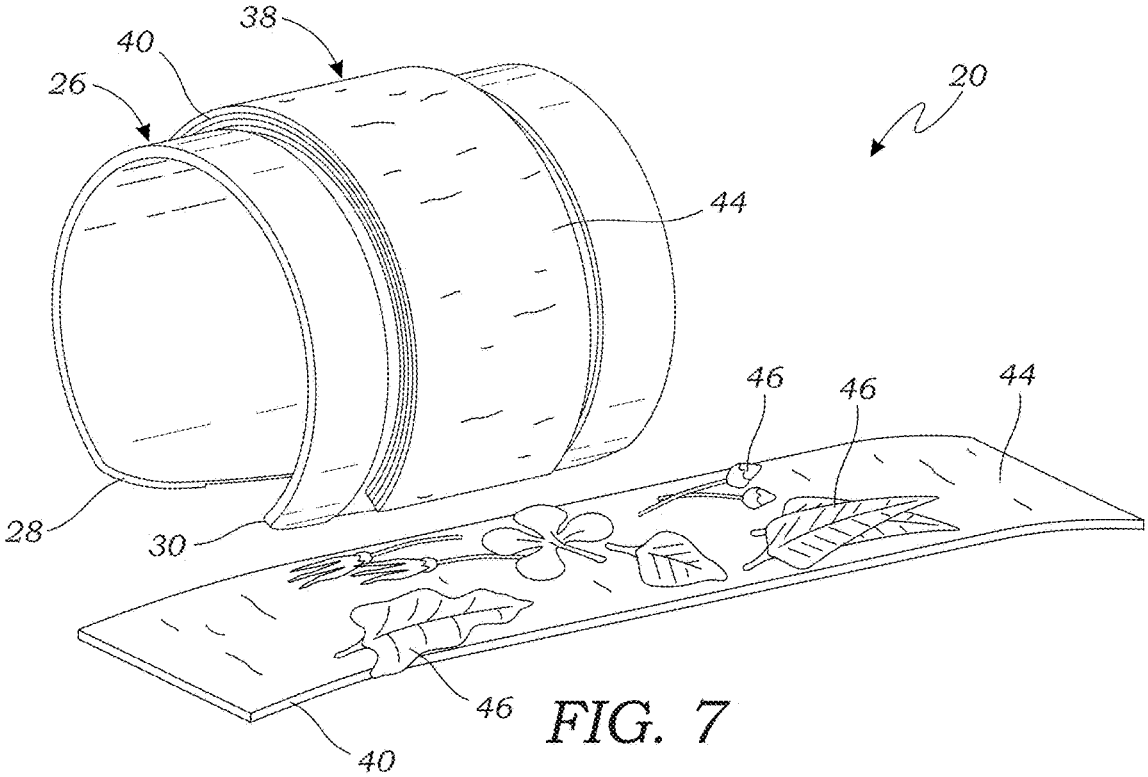

In at least one embodiment, the apparatus 20 further provides an at least one stack 38 of adhesive strips 40 engaged with an outer surface 42 of the cuff portion 26. Each of the at least one stack 38 of adhesive strips 40 provides a plurality of adhesive strips 40 arranged in a stacked, removably engageable orientation, with an adhesive surface 44 of each adhesive strip 40 in the at least one stack 38 facing outward (i.e., in a direction away from the outer surface 42 of the cuff portion 26). Accordingly, the adhesive surface 44 of an uppermost adhesive strip 40 in the at least one stack 38 is exposed. In at least one embodiment, a temporary backing layer (not shown) is removably engaged with the adhesive surface 44 of the uppermost adhesive strip 40 in the at least one stack 38, thereby protecting the adhesive surface 44 of the uppermost adhesive strip 40 in the at least one stack 38 prior to the apparatus 20 first being used. As discussed further below, and as illustrated in FIGS. 5-7, the adhesive surface 44 of the uppermost adhesive strip 40 in the at least one stack 38 is configured for receiving thereon an at least one object collected by a user 24 of the apparatus 20—e.g., flowers, leaves, sticks, rocks, or virtually any other object, now known or later developed, sized and shaped for being engageable with the adhesive surface 44 of the uppermost adhesive strip 40 in the at least one stack 38 (collectively referred to generally herein as a "collected object 46" for simplicity purposes). During use of the apparatus 20, the uppermost adhesive strip 40 in the at least one stack 38 may be selectively peeled away from said stack 38 as desired by the user 24 (for example, upon the adhesive surface 44 of the uppermost adhesive strip 40 being filled with collected objects 46), thereby exposing the adhesive surface 44 of the next adhesive strip 40 in said stack 38. This can be repeated until all of the adhesive strips 40 in said stack 38 have been used and removed. In at least one embodiment, upon exhausting all adhesive strips 40 in the at least one stack 38, a new stack 38 of adhesive strips 40 may be engaged with outer surface 42 of the cuff portion 26. In at least one alternate embodiment, the apparatus 20 is designed to be disposable, such that upon exhausting all adhesive strips 40 in the at least one stack 38, the cuff portion 26 is discarded. It should be noted that, in further embodiments, the at least one stack 38 of adhesive strips 40 may take on any other sizes, shapes, dimensions, quantities, configurations and/or relative positions on the cuff portion 26, now known or later developed, so long as the apparatus 20 is capable of substantially carrying out the functionality described herein.

In at least one embodiment, the outer surface 42 of the cuff portion 26 provides an at least one stack engagement mechanism 48 positioned and configured for securing (either permanently or temporarily) the at least one stack 38 of adhesive strips 40 thereon. In at least one such embodiment, the at least one stack engagement mechanism 48 is configured for securing a lowermost adhesive strip 40 in the at least one stack 38 to the outer surface 42 of the cuff portion 26. In at least one alternate embodiment, the at least one stack engagement mechanism 48 is configured for securing a base layer 50 (on which the lowermost adhesive strip 40 in the at least one stack 38 is positioned) to the outer surface 42 of the cuff portion 26. In at least one embodiment, the at least one stack engagement mechanism 48 is an adhesive layer positioned on the outer surface 42 of the cuff portion 26. In further embodiments, the at least one stack engagement mechanism 48 may be any other mechanism, structure or material, now known or later developed, capable of securing (either permanently or temporarily) the at least one stack 38 of adhesive strips 40 on the outer surface 42 of the cuff portion 26.

Figure 4:
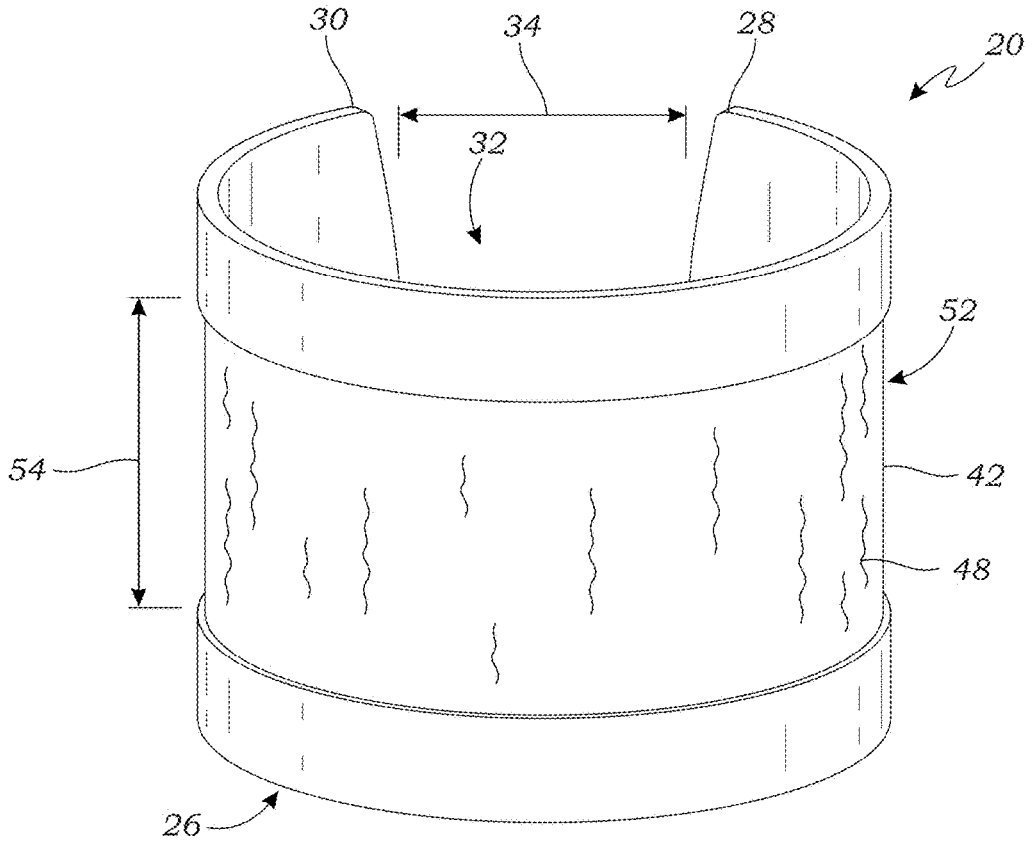
FIG. 4 is a perspective view of an exemplary cuff portion of the apparatus, in accordance with at least one embodiment.

In at least one embodiment, as best illustrated in FIG. 4, the outer surface 42 of the cuff portion 26 provides an at least one annular recess 52 sized and configured for receiving the at least one stack 38 of adhesive strips 40 therewithin. In at least one embodiment, one or more of the at least one annular recess 52 extends longitudinally in a direction between the first terminal end 28 and the second terminal end 30. In at least one embodiment, the at least one annular recess 52 extends an entire length/circumference of the cuff portion 26. In at least one alternate embodiment, the at least one annular recess 52 extends less than the entire length/circumference of the cuff portion 26. In at least one embodiment, the at least one annular recess 52 has a recess width 54 that approximates a strip width 56 of the corresponding at least one stack 38 of adhesive strips 40. In at least one embodiment, the at least one annular recess 52 is sized and configured for receiving more than one stack 38 of adhesive strips 40 therewithin. Thus, it should be noted that, in further embodiments, the at least one annular recess 52 may take on any other sizes, shapes, dimensions, quantities, configurations and/or relative positions on the cuff portion 26, now known or later developed, so long as the apparatus 20 is capable of substantially carrying out the functionality described herein. In at least one embodiment, the at least one annular recess 52 may be omitted altogether. In at least one embodiment, the at least one stack engagement mechanism 48 is positioned within or otherwise provided by the at least one annular recess 52.

In at least one embodiment, as best illustrated in FIGS. 5-7, during use of the apparatus 20, the cuff portion 26 is removably engaged with the target site 22, and the user 24 is able to selectively place one or more collected objects 46 onto the adhesive surface 44 of the uppermost adhesive strip 40 in the at least one stack 38 (FIG. 5). Upon the adhesive surface 44 of the uppermost adhesive strip 40 being filled with collected objects 46 (or sooner if the user 24 desires), the uppermost adhesive strip 40 may be selectively peeled away from said stack 38 (FIG. 6), thereby exposing the adhesive surface 44 of the next adhesive strip 40 in said stack 38 (FIG. 7). This can be repeated until all of the adhesive strips 40 in said stack 38 have been used and removed. In the meantime, at any point, should the user 24 desire to stop using the apparatus 20, the cuff portion 26 can be disengaged from the target site 22 and placed on a surface or stored elsewhere until a later point in time when the user 24 desires to use the apparatus 20 once again, at which point the cuff portion 26 can be removably re-engaged with the target site 22. Thus, because the cuff portion 26 is removably engaged with the target site 22 (thereby allowing it to be put on and taken off as desired by the user 24), the uppermost adhesive strip 40 is capable of multiple uses, and only needs to be peeled away from the corresponding stack 38 upon being filled with collected objects 46 (unless the user 24 decides to remove the uppermost adhesive strip 40 sooner). Furthermore, because the at least one stack 38 of adhesive strips 40 is supported on the outer surface 42 of the cuff portion 26, the cuff portion 26 provides a relatively stable surface on which the collected objects 46 can be supported and displayed-both when the cuff portion 26 is engaged with the target site 22 and when not in use.

Aspects of the present specification may also be described as the following embodiments:

1. A reusable adhesive wearable apparatus comprising: a cuff portion removably engageable with a target site; an at least one stack of adhesive strips engaged with an outer surface of the cuff portion; and each of the at least one stack of adhesive strips providing a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object; whereby, during use of the apparatus, the uppermost adhesive strip in the at least one stack may be selectively peeled away from said stack as desired, thereby exposing the adhesive surface of a next adhesive strip in said stack.

2. The reusable adhesive wearable apparatus according to embodiment 1, wherein the cuff portion is constructed out of a relatively rigid material.

3. The reusable adhesive wearable apparatus according to embodiments 1-2, wherein the cuff portion is constructed out of a relatively semi-rigid or resilient material.

4. The reusable adhesive wearable apparatus according to embodiments 1-3, wherein the cuff portion is sized and configured for extending around an entire circumference of the target site.

5. The reusable adhesive wearable apparatus according to embodiments 1-4, wherein the cuff portion is a continuous ring-like structure.

6. The reusable adhesive wearable apparatus according to embodiments 1-5, wherein the cuff portion is sized and configured for extending around less than an entire circumference of the target site.

7. The reusable adhesive wearable apparatus according to embodiments 1-6, wherein the cuff portion is a non-continuous ring-like structure having a first terminal end and an opposing second terminal end.

8. The reusable adhesive wearable apparatus according to embodiments 1-7, wherein the cuff portion defines a cuff gap between the first terminal end and the second terminal end.

9. The reusable adhesive wearable apparatus according to embodiments 1-8, wherein the cuff gap is a uniformly sized space between the first terminal end and the second terminal end.

10. The reusable adhesive wearable apparatus according to embodiments 1-9, wherein the cuff gap is tapered.

11. The reusable adhesive wearable apparatus according to embodiments 1-10, wherein the cuff portion provides an at least one cuff engagement mechanism positioned and configured for creating a removable engagement between the cuff portion and the target site.

12. The reusable adhesive wearable apparatus according to embodiments 1-11, wherein the at least one cuff engagement mechanism is positioned and configured for temporarily joining the first terminal end and the second terminal end.

13. The reusable adhesive wearable apparatus according to embodiments 1-12, wherein the at least one cuff engagement mechanism is one of hook-and-loop fasteners, buttons, snaps, magnets, or buckles.

14. The reusable adhesive wearable apparatus according to embodiments 1-13, further comprising a temporary backing layer removably engaged with the adhesive surface of the uppermost adhesive strip in the at least one stack, thereby protecting the adhesive surface of the uppermost adhesive strip in the at least one stack prior to the apparatus first being used.

15. The reusable adhesive wearable apparatus according to embodiments 1-14, wherein the outer surface of the cuff portion provides an at least one stack engagement mechanism positioned and configured for the at least one stack of adhesive strips thereon.

16. The reusable adhesive wearable apparatus according to embodiments 1-15, wherein the at least one stack engagement mechanism is an adhesive layer positioned on the outer surface of the cuff portion.

17. The reusable adhesive wearable apparatus according to embodiments 1-16, wherein the outer surface of the cuff portion provides an at least one annular recess sized and configured for receiving the at least one stack of adhesive strips therewithin.

18. The reusable adhesive wearable apparatus according to embodiments 1-17, wherein the at least one annular recess extends longitudinally in a direction between the first terminal end and the second terminal end.

19. The reusable adhesive wearable apparatus according to embodiments 1-18, wherein the at least one annular recess extends an entire length of the cuff portion.

20. The reusable adhesive wearable apparatus according to embodiments 1-19, wherein the at least one annular recess extends less than the entire length of the cuff portion.

21. The reusable adhesive wearable apparatus according to embodiments 1-20, wherein the at least one annular recess has a recess width that approximates a strip width of the corresponding at least one stack of adhesive strips.

22. The reusable adhesive wearable apparatus according to embodiments 1-21, wherein the at least one annular recess is sized and configured for receiving more than one stack of adhesive strips therewithin.

23. The reusable adhesive wearable apparatus according to embodiments 1-22, wherein the at least one stack engagement mechanism is positioned within or otherwise provided by the at least one annular recess.

24. The reusable adhesive wearable apparatus according to embodiments 1-23, wherein the cuff portion is configured as a bracelet.

25. A reusable adhesive wearable apparatus comprising: a cuff portion removably engageable with a target site, an outer surface of the cuff portion providing an at least one annular recess; an at least one stack of adhesive strips positioned within the at least one annular recess of the cuff portion; and each of the at least one stack of adhesive strips providing a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object; whereby, during use of the apparatus, the uppermost adhesive strip in the at least one stack may be selectively peeled away from said stack as desired, thereby exposing the adhesive surface of a next adhesive strip in said stack.

26. A reusable adhesive wearable apparatus comprising: a cuff portion removably engageable with a target site, the cuff portion having a non-continuous ring-like structure extending between a first terminal end and an opposing second terminal end; an outer surface of the cuff portion providing an at least one annular recess extending longitudinally in a direction between the first terminal end and the second terminal end; an at least one stack of adhesive strips positioned within the at least one annular recess of the cuff portion; and each of the at least one stack of adhesive strips providing a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object; whereby, during use of the apparatus, the uppermost adhesive strip in the at least one stack may be selectively peeled away from said stack as desired, thereby exposing the adhesive surface of a next adhesive strip in said stack.

In closing, regarding the exemplary embodiments of the present invention as shown and described herein, it will be appreciated that a reusable adhesive wearable apparatus is disclosed and configured for being both re-worn and re-used. Because the principles of the invention may be practiced in a number of configurations beyond those shown and described, it is to be understood that the invention is not in any way limited by the exemplary embodiments, but is generally directed to a reusable adhesive wearable apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the terms "about" and "approximately." As used herein, the terms "about" and "approximately" mean that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art, or at least encompassing a range of plus or minus ten percent above and below the value of the stated characteristic, item, quantity, parameter, property, or term.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators-such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that any methods disclosed herein, along with the order in which the respective elements of any such method are performed, are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents are based on the information available to the applicant and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A reusable adhesive wearable apparatus comprising:

a cuff portion removably engageable with a target site, an outer surface of the cuff portion providing an at least one substantially annular shaped recess;

an at least one stack of adhesive strips positioned within the at least one substantially annular shaped recess of the cuff portion; and each of the at least one stack of adhesive strips providing a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object;

whereby, during use of the apparatus, the uppermost adhesive strip in the at least one stack may be selectively peeled away from said stack as desired, thereby exposing the adhesive surface of a next adhesive strip in said stack.

2. The reusable adhesive wearable apparatus of claim 1, wherein the cuff portion is constructed out of a relatively rigid material.

3. The reusable adhesive wearable apparatus of claim 1, wherein the cuff portion is constructed out of a relatively semi-rigid or resilient material.

4. The reusable adhesive wearable apparatus of claim 1, wherein the cuff portion is sized and configured for extending around an entire circumference of the target site.

5. The reusable adhesive wearable apparatus of claim 1, wherein the cuff portion is sized and configured for extending around less than an entire circumference of the target site.

6. The reusable adhesive wearable apparatus of claim 5, wherein the cuff portion is a non-continuous ring-like structure having a first terminal end and an opposing second terminal end.

7. The reusable adhesive wearable apparatus of claim 6, wherein the cuff portion defines a cuff gap between the first terminal end and the second terminal end.

8. The reusable adhesive wearable apparatus of claim 7, wherein the cuff gap is a uniformly sized space between the first terminal end and the second terminal end.

9. The reusable adhesive wearable apparatus of claim 7, wherein the cuff gap is tapered.

10. The reusable adhesive wearable apparatus of claim 6, wherein the cuff portion provides an at least one cuff engagement mechanism positioned and configured for creating a removable engagement between the cuff portion and the target site.

11. The reusable adhesive wearable apparatus of claim 10, wherein the at least one cuff engagement mechanism is positioned and configured for temporarily joining the first terminal end and the second terminal end.

12. The reusable adhesive wearable apparatus of claim 1, wherein the outer surface of the cuff portion provides an at least one stack engagement mechanism positioned and configured for the at least one stack of adhesive strips thereon.

13. The reusable adhesive wearable apparatus of claim 12, wherein the at least one stack engagement mechanism is an adhesive layer positioned on the outer surface of the cuff portion.

14. The reusable adhesive wearable apparatus of claim 1, wherein the at least one substantially annular shaped recess extends an entire length of the cuff portion.

15. The reusable adhesive wearable apparatus of claim 1, wherein the at least one substantially annular shaped recess extends less than the entire length of the cuff portion.

16. The reusable adhesive wearable apparatus of claim 1, wherein the cuff portion is configured as a bracelet.

17. A reusable adhesive wearable apparatus comprising:

a cuff portion removably engageable with a target site, an outer surface of the cuff portion providing an at least one substantially annular shaped recess extending an entire length of the cuff portion;

an at least one stack of adhesive strips positioned within the at least one substantially annular shaped recess of the cuff portion; and each of the at least one stack of adhesive strips providing a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object;

whereby, during use of the apparatus, the uppermost adhesive strip in the at least one stack may be selectively peeled away from said stack as desired, thereby exposing the adhesive surface of a next adhesive strip in said stack.

18. A reusable adhesive wearable apparatus comprising:

a cuff portion removably engageable with a target site, the cuff portion having a non-continuous ring-like structure extending between a first terminal end and an opposing second terminal end;

an outer surface of the cuff portion providing an at least one substantially annular shaped recess extending longitudinally in a direction between the first terminal end and the second terminal end;

an at least one stack of adhesive strips positioned within the at least one substantially annular shaped recess of the cuff portion; and each of the at least one stack of adhesive strips providing a plurality of adhesive strips arranged in a stacked, removably engageable orientation, with an adhesive surface of each adhesive strip in the at least one stack facing outward, such that the adhesive surface of an uppermost adhesive strip in the at least one stack is exposed and capable of receiving thereon an at least one collected object;

whereby, during use of the apparatus, the uppermost adhesive strip in the at least one stack may be selectively peeled away from said stack as desired, thereby exposing the adhesive surface of a next adhesive strip in said stack.

* * * * *